United States Patent [19]

Matsuo et al.

[11] Patent Number: 4,974,828

[45] Date of Patent: Dec. 4, 1990

[54] SHEET STACKING APPARATUS

[75] Inventors: Kazuhiro Matsuo, Tokyo; Hideaki Furukawa, Yokohama, both of Japan

[73] Assignee: Canon Kabushiki Kaisha, Tokyo, Japan

[21] Appl. No.: 492,296

[22] Filed: Feb. 28, 1990

Related U.S. Application Data

[63] Continuation of Ser. No. 86,814, Aug. 19, 1987, abandoned.

[30] Foreign Application Priority Data

Aug. 20, 1986 [JP] Japan ..... 61-196258
Jan. 23, 1987 [JP] Japan ..... 62-012490

[51] Int. Cl.[5] ..... B65H 29/20

[52] U.S. Cl. ..... 271/293; 271/176; 271/202; 271/270; 271/294; 271/314

[58] Field of Search ..... 271/270, 176, 202, 314, 271/270, 294, 293

[56] References Cited

U.S. PATENT DOCUMENTS

| | | | |
|---|---|---|---|
| 3,988,018 | 10/1976 | Tusso | 271/202 X |
| 4,449,706 | 5/1984 | Snellman | 271/270 X |
| 4,579,327 | 4/1986 | Furuichi | 271/202 X |
| 4,580,775 | 4/1986 | Maruyama | 271/293 |
| 4,629,172 | 12/1986 | Kameyama | 271/270 X |
| 4,667,951 | 5/1987 | Honjo | 271/202 X |
| 4,676,499 | 6/1987 | Kimizuka | 271/202 X |

*Primary Examiner*—Richard A. Schacher
*Attorney, Agent, or Firm*—Fitzpatrick Cella, Harper & Scinto

[57] ABSTRACT

A sheet stacking apparatus usable with an image forming apparatus having a sheet discharging outlet includes a sheet stacking portion, a conveyer for receiving a sheet material from the sheet outlet of the image forming apparatus and for conveying the sheet material to the sheet stacking portion, speed controller for changing a conveying speed of the conveyer to provide a first conveying speed while the sheet material is being confined by the image forming apparatus and to provide a second conveying speed which is higher than the first speed after the sheet material is released from the image forming apparatus.

21 Claims, 11 Drawing Sheets

SHEET STACKING APPARATUS

This application is a continuation of application Ser. No. 07/086,814 filed Aug. 19, 1987, now abandoned.

FIELD OF THE INVENTION AND RELATED ART

The present invention relates to a sheet stacking apparatus, more particularly to a sheet stacking apparatus such as a sorter for sorting sheets discharged from an image forming apparatus such as a copying machine, a printer and a recording apparatus. This invention also relates to an image forming apparatus provided with such a sheet stacking apparatus. In one aspect of the present invention, it relates to switching and control of a sheet conveying speed.

A sorter is known which is attached to image forming apparatus such as copying machines to sort or collate the sheets discharged from the image forming apparatus. In the conventional sorters, the sheet conveying speed is constant.

Those sorters involve a problem that if such a sorter is used with an image forming apparatus which discharges sheets at a speed lower than the sheet conveying speed of the sorter, the sheet is stretched between the sorter and the image forming apparatus due to the speed difference therebetween with the result of slip between the sheet and the sorter or between the sheet and the sheet conveying roller of the image forming apparatus so that a noise is produced or that the rollers are worn. In an attempt to solve this problem, the sheet conveying speed of the sorter may be changed to be equal to the low speed of the image forming apparatus. However, then, the sheet is discharged onto the sorter at an insufficient shooting speed, which leads to disturbance to the alignment of the sheets on the tray.

U.S. Ser. No. 839,610 filed on Mar. 14, 1986 and assigned to the assignee of the present application discloses that the speed at which the sheet is discharged onto an alignment tray by discharging rollers is sufficiently reduced by the sheet feeding speed in the conveying system, whereby the disturbance to the sheets by the existence of the air layer under the sheet is eliminated during the time from the sheet being shot to the time of the sheet being aligned on the tray, whereby the sheets are aligned in the lateral direction. This invention is intended to improve the alignment of the sheets where the conveying speed is very high. Therefore, the invention does not solve the problem described above.

SUMMARY OF THE INVENTION

Accordingly, it is a principal object of the present invention to provide a sheet handling apparatus, more particularly to a sheet stacking apparatus and an image forming apparatus provided with the sheet stacking apparatus, wherein a sheet is discharged onto a tray of the sheet stacking apparatus which can meet the sheet discharging speed of an image forming apparatus.

It is another object of the present invention to provide a sheet handling apparatus or the like wherein sheets discharged by the sheet stacking apparatus onto its tray are satisfactorily aligned.

In an embodiment of the present invention, the sheet conveying speed is controlled so as to be at predetermined levels during respective predetermined periods, in response to sheet discharging signals provided from an image forming or recording apparatus used with the sheet stacking apparatus.

More particularly, the sheet stacking apparatus comprises conveying means for conveying and discharging the sheet to a sheet receiving tray and means for changing the sheet conveying speed, wherein when it is connected with an image forming apparatus which discharges the sheet at a speed different from the sheet conveying speed of the sheet stacking apparatus, the sheet conveying speed of the sheet stacking apparatus is changed to meet the sheet discharging speed of the image forming apparatus during the period of the sheet being confined or bound by the image forming apparatus, whereas when the sheet is released from the image forming apparatus, the sheet conveying speed of the sheet stacking apparatus is changed, more particularly, increased.

Thus, the sheet is not stretched between the sorter and the image forming apparatus, whereby the noise and the wearing of the rollers can be prevented. Additionally, the sheet stacking apparatus can be used with various image forming apparatuses.

Even when the sheet stacking apparatus, more particularly, a sorter is connected with an image forming apparatus which discharges sheets at a lower speed, there is no significant difference in the sheet conveying speed between the sorter and the image forming apparatus, while the image forming apparatus is conveying the sheet. Still, as soon as the sheet is released from the image forming apparatus, the sheet is discharged at a predetermined different speed suitable to allow the sheets to be aligned.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
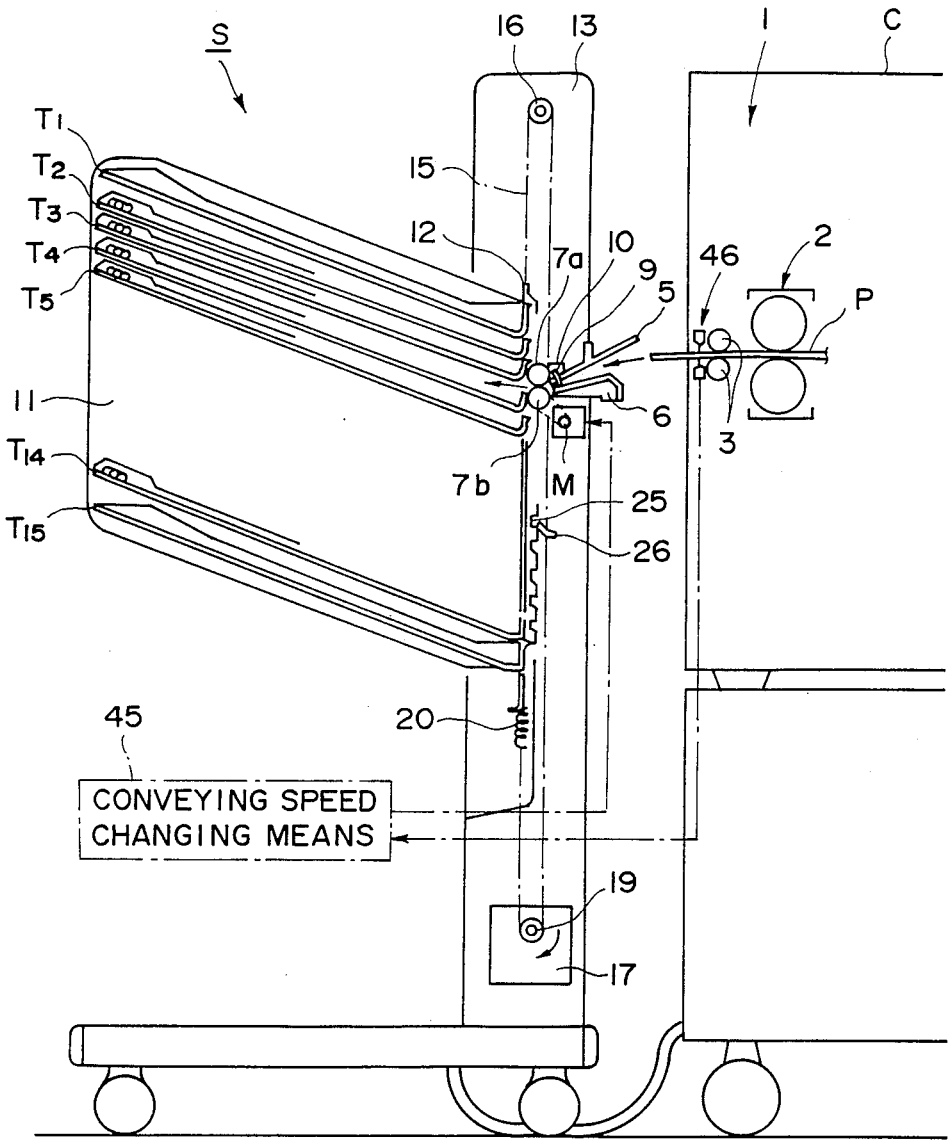
FIG. 1 is a sectional view of a sorter connected with a copying machine, according to an embodiment of the present invention.

Referring to FIG. 1, there is shown a sheet stacking apparatus according to an embodiment of the present invention, which in this embodiment is connected to a copying machine C which discharges sheets at a relatively low speed. The exemplary sheet stacking apparatus is a sorter S. As shown in FIG. 1, the copying machine C is provided with an image fixing device 2 adjacent a sheet discharging station 1. The sheet discharging station has adjacent the image fixing device 2 a couple of discharging rollers 3 which serve to discharge toward the sorter S a sheet P which bears a transferred image having been fixed by the image fixing device 2. The sorter S includes a set of trays, more particularly, 15 trays T1–T15 in this embodiment and is provided with a sheet inlet equipped with top and bottom sheet receiving guides 5 and 6. Downstream and adjacent to the sheet receiving guides 5 and 6 is a couple of conveying rollers *7a* and *7b* to receive the sheet P coming between the sheet receiving guides 5 and 6 and to discharge the sheet P onto one of said trays T1–T15. For the sheet passage defined by the sheet receiving guides 5 and 6, a sheet detecting lever 9 and a sheet detecting sensor 10 are disposed to detect the sheet P advancing to the trays T1–T15. The trays T1–T15 are mounted to a tray supporting plate 11 at their lateral sides. The tray supporting plate 11 is mounted to an elevating member 12 which is movable substantially vertically, so that the set of trays T1–T15 is movable as a unit in the substantially vertical direction, and therefore, any one of the trays T1–T15 can selectively be faced to the couple of conveying rollers *7a* and *7b*.

The elevating member 12 is vertically movable along a vertical post 13 at least through a distance corresponding to the vertical distance between the top tray T1 and the bottom tray T15. To the top of the elevating member 12, an end of a chain or wire 15 is fixed. The chain 15 is deflected by an upper idle sprocket 16 and is extended downwardly toward a sprocket 19, around which the chain 15 is trained. The sprocket 19 is coupled to an output shaft of a motor 17. The opposite end of the chain 15 is fixed to the bottom of the elevating member 12 through a spring 20. Therefore, when the motor 17 is energized to rotate in the clockwise direction in FIG. 1, the set of trays T1–T15 is integrally lifted together with the elevating member 12.

Figure 2:
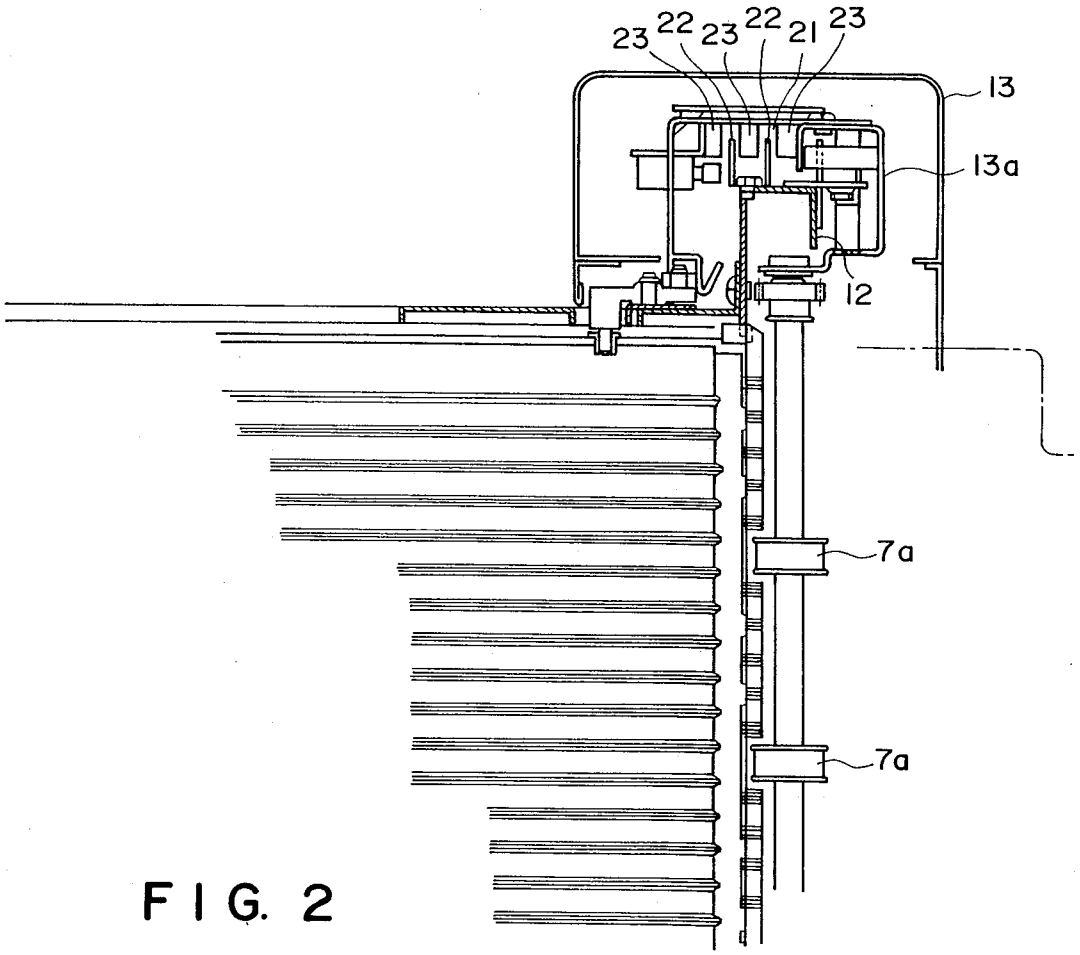
FIG. 2 is an enlarged top plan view of the apparatus of FIG. 1.

Referring to FIG. 2 which is an enlarged top plan view partly sectional adjacent the post 13 of the sorter S and also referring to FIG. 3 which is an enlarged side view of the elevating member 12, a mechanism for positioning the trays T1–T15 will be described. In the post 13, as shown in FIG. 2, saw-tooth plate 22 is fixed to the elevating member 12 and is movable along a groove 21. The saw-tooth plate 22 functions to position the trays. The saw-tooth plate 22 has saw-teeth formed at the intervals corresponding to the tray intervals. A position sensor 23 comprising a light emitting element and a photoreceptor detects the light passing through the cut-away portion of the saw-tooth plate 22 to correctly position the tray.

Figure 3:
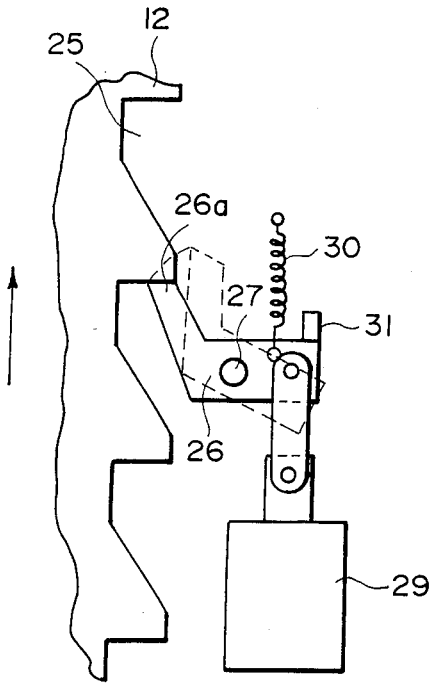
FIG. 3 is an enlarged side view of an elevating member of the apparatus of FIG. 1.

As shown in FIG. 3, the elevating member 12 is provided with cut-away portions 25. Opposed to the cut-away portion 25 of the elevating member 12 is a stopper 26 for stopping the elevating member 12. The stopper 26 is pivotable about a rotational axis about a stopper shaft 27 between a solid line position in which a pawl *26a* engages with the cut-away portion 25 of the elevating member 12 and a broken line position wherein the pawl *26a* is out of engagement therewith. When the tray set is returned to an initial position, that is, the bottommost position from the topmost or any given position, a solenoid connected to the stopper 26 is energized to pivot the stopper 26 so as to disengage the pawl *26a* from the cut-away portion 25. During stepwise elevating of the tray at the intervals corresponding to the tray intervals, it is not necessary to energize the solenoid 19, and a reset spring 30 of the stopper 26 is effective to engage the pawl *26a* into the cut-away portion 25 of the elevating member 12 to stop the tray set at correct intervals. In the example shown in FIG. 3, when the elevating member 12 overruns through about 5 mm, the reset spring 30 engages the pawl *26a* into the cut-away portion 25 of the elevating member 12. Where an electromagnetic brake is not used, the elevating member 12 falls by its own weight when the motor 17 stops, and the elevating member stopper 26 is pushed to the solid line position (FIG. 3), with the result that the rear end of the stopper 26 engages a rear stopper 31, so that the elevating member 12 is stopped at a proper position. Therefore, the cut-away portions 25 are formed so that the individual tray inlet can be aligned with the couple of conveying rollers *7a* and *7b*. The cut-away portions 25 may be formed in the tray set, since then the positional accuracy is improved.

In operation, the motor 17 starts to rotate in the counterclockwise direction so as to lower the set of trays T1–T15 to its bottommost position, upon which the sheet inlet of the topmost tray T1 is aligned with the nip formed between the conveying rollers *7a* and *7b*. The alignment reached is detected by the position sensor 23, and then the motor 17 stops under the control of a suitable control circuit, and simultaneously, the tray set is maintained at the bottommost initial position by an unshown electromagnetic brake. It is a possible alternative that the motor 17 is rotated for a predetermined period provided by a proper timer with the sensor 23 omitted. Where the electromagnetic brake is employed, the above described mechanism explained in conjunction with FIG. 3 is adopted in order to prevent the set of trays T1–T15 from falling by its own weight when the motor is deenergized. When the sheet P is introduced onto the tray T1, and the sheet detecting lever 9 and the sheet detecting sensor 10 detect the sheet P on the tray T1, the motor 17 is energized to rotate in the clockwise direction after detection of the rear edge of the sheet P. Then, the tray set is elevated so that the cut-away portion of the saw-tooth plate 22 which corresponds to the second tray T2 is detected by the position detecting sensor 23, in response to which the motor 17 stops with the electromagnetic brake operated. Thus, the second tray T2 is prepared for receiving the sheet P. Thereafter, the sheet P is discharged onto the second tray T2.

The above described operation is repeated a required number of times. Then, the tray set is returned to the initial bottommost position in response to a reset signal. The spring 20 connecting the elevating member 12 and the end of the chain 15 functions to buffer the shock during movement of the tray set.

Where the positioning is performed by using the position detecting sensor 23 and the electromagnetic brake, the stopper 26 illustrated in FIG. 3 is advantageous. When the power supply to the apparatus is shut down, the electromagnetic brake becomes inoperative so that there is a possibility that the tray set falls. However, because of the provision of the elevating member stopper 26, it is effective to stop the elevating member 12, and therefore, the tray set is prevented from falling by its own weight even when the power supply to the motor stops.

Figure 4:
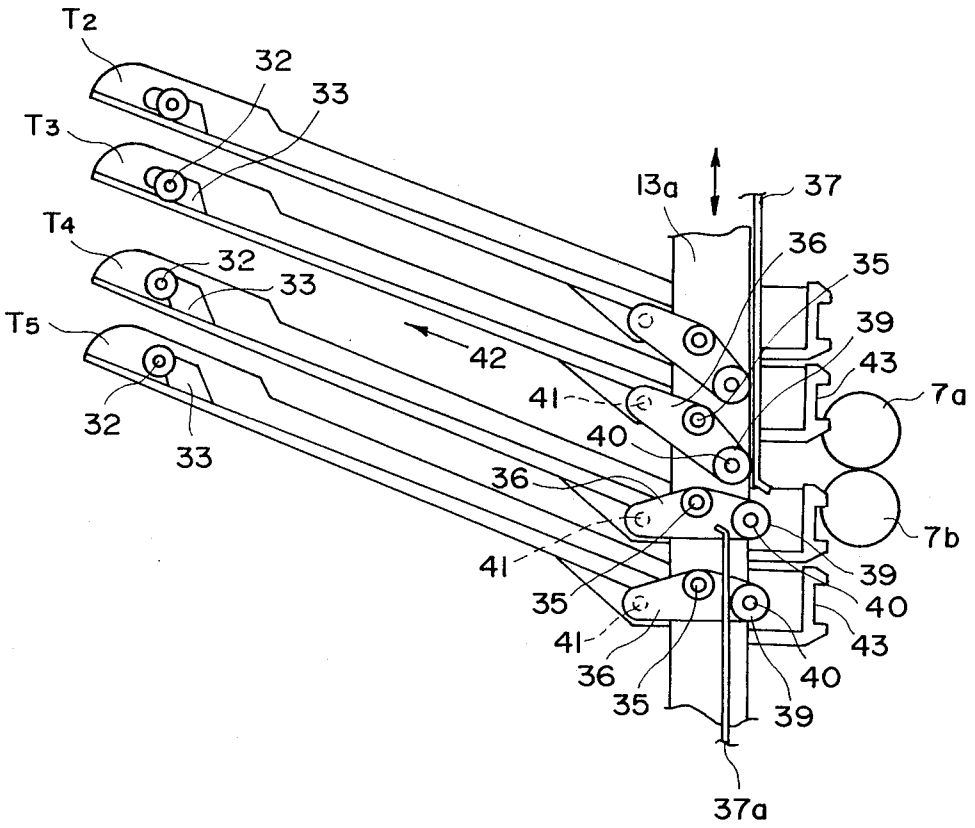
FIG. 4 is an enlarged side view of a tray of the apparatus of FIG. 1.

Referring to FIG. 4, the operation of the trays T1–T16 will be described. FIG. 4 is an enlarged side view with the topmost tray T1 and the bottom trays T6–T15 omitted, to illustrate elevation of the trays. For each of the trays T2–T14 except for the topmost and bottommost trays T1 and T15, a pin 32 is fixed to the supporting plate 11 and is engaged into an elongated slot 33 of each of the trays T2–T14. Adjacent an inlet of each of the trays, a pin 35 is fixed to the tray. The pin 35 rotatably supports an arm lever 36. The arm lever 36 is provided with a roller 39 rotatable about a pin 40 fixed to the arm lever 36. The roller 39 is contactable to a stationary cam plate 37 fixed on an inside post 13*a*. Adjacent the opposite end of the arm lever 36, a pin 41 is fixed thereto and is rotatably supported in a hole of the tray T. The tray T is inclined as shown in FIG. 4 so that the received sheet slides by its own weight to be aligned at the trailing edge thereof.

In operation, when the tray T is raised, the roller 39 rolls over the cam surface of the stationary cam plate 37 upwardly. By the cam plate 37, the roller 39 pivots about the pin 35 in the clockwise direction. As a result, the upper tray, the third tray T3 for example, is moved upwardly by the pin 41 so as to open the sheet inlet for the lower tray, that is, the fourth tray T4 in this example. At this time, the third tray T3 moves in a sheet conveying direction 42 so that even if the tray T3 pivots about a pin 32, the distance between an end surface 43 at the tray inlet side and the conveying roller couple (*7a* and *7b*) remains unchanged. The dimensions of the cam plate 37 and the roller 39 are determined to achieve this.

When the tray set lowers, the fourth tray T4 is contacted to a resetting cam 37*a* to be rotated in the counterclockwise direction, after the roller 39 of the arm lever 36 is disengaged from the cam plate 37. Then, by the action of the pin 41 of the arm lever 36, the inlet of the fourth tray T4 moves downwardly beyond the downward movement distance of the elevating member 12. More particularly, the pin 35 of the arm lever 36 moves together with the elevating member 12, and therefore, the arm lever 36, when moving upwardly, rotates in the clockwise direction by the engagement of the roller 39 to the cam plate 37, and the pin 41 adds a further movement on the upward movement of the elevating member 12. During the lowering movement, the resetting cam 37*a* similarly rotates the arm lever 36 in the counterclockwise direction so that the lowering amount of the pin 41 is added to the tray in addition to the downward movement of the elevating member 12. Each of the trays T2–T14 except the topmost and bottommost trays T1 and T15, performs the same operation so as to provide a larger sheet receiving area when it is faced to the nip of the conveying roller couple constituted by the rollers *7a* and *7b*, thus providing an improved access of the sheet to the tray.

Figure 5:
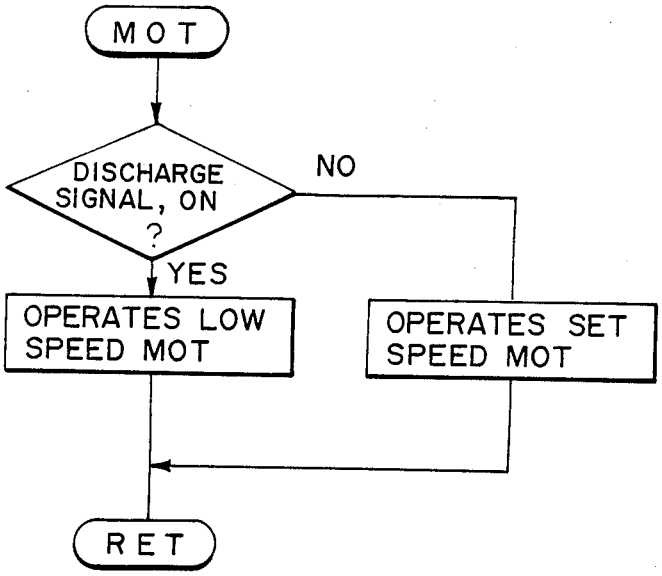
FIG. 5 is a flow chart illustrating operations of the apparatus of FIG. 1.
Figure 6:
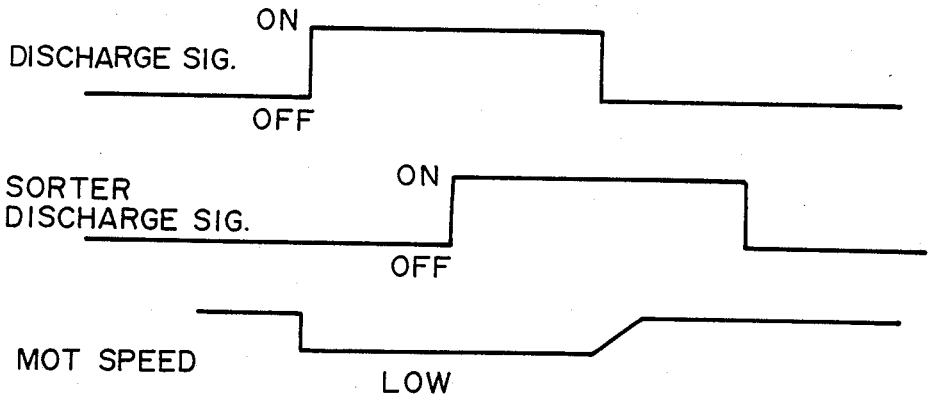
FIG. 6 is a timing chart illustrating an operation of FIG. 1 apparatus.

On the other hand, the sorter S is equipped with a conveying motor M for driving the couple of conveying rollers *7a* and *7b*, as shown in FIG. 1. The sorter S is also provided with a conveying speed switching means 45 for changing the sheet conveying speed by the conveying rollers *7a* and *7b* by increasing or decreasing the rotational speed of the conveying roller M. A sheet detecting sensor 46 is disposed close to the discharging rollers 3 of the copying machine C to detect the sheet P discharged therefrom. The detection signal is transmitted to the sheet conveying speed switching means 45. Upon the conveying speed switching means 45 receiving the sheet detection signal from the discharge sheet detecting sensor 46, it reduces the rotational speed of the motor M to change the sheet conveying speed of the conveying rollers *7a* and *7b* from its normal speed down to a lower speed which is equal or only slightly higher than the sheet discharging speed of the copying machine C. When the switching means 45 receives a signal indicative of absence of the sheet P from the discharged sheet detecting sensor 46, that is, when the trailing edge of the sheet P is released from the copying machine C, more particularly, the discharging rollers 3 of the copying machine, the switching means 45 increases the rotational speed of the motor M to reset the sheet conveying speed of the discharging rollers *7a* and *7b* up to its normal speed, as shown in FIGS. 5 and 6.

The sheet conveying operation by the sorter S will be further described. The sheet P is subjected to an image fixing operation by the image fixing device 2 and is discharged from the copying machine C at a relatively low speed by the discharging rollers 3 toward the sorter S. Then, the discharge sheet detecting sensor 46 is actuated and detects that the sheet P is discharged from the copying machine C but is still confined by the image fixing device 2 and/or the discharging rollers 3. When the sheet detecting signal is transmitted to the conveying speed switching means 45 such as a switch provided in the sorter S from the discharged sheet detecting sensor 46, the sheet conveying speed of the conveying rollers *7a* and *7b* is switched from the normal conveying speed of the sorter S to a lower speed so as to meet the slower discharge of the copying machine C. The leading edge of the discharged sheet P is received by the sheet inlet of the sorter S and is caught by the nip between the conveying rollers *7a* and *7b* which have been switched to a lower speed mode. Then, the sheet conveying speed of the sorter S and the sheet discharging speed of the copying machine C are substantially equal, and therefore the discharged sheet P is not stretched therebetween.

When the trailing edge of the discharged sheet P is released from confinement by the copying machine C, the discharge sheet detecting sensor 46 is deactivated. This event is transmitted in the form of an off signal to the conveying speed switching means 45, in response to which the switching means 45 resets the sheet conveying speed of the conveying rollers *7a* and *7b* to the normal higher speed. Then, the sheet P is shot onto the tray at the normal higher speed by the conveying rollers *7a* and *7b* rotating at the higher speed and is received thereon. When the sheet P is received by the tray, the event is detected by the sheet detecting lever 9 and the sheet detecting sensor 10. Then, the tray set is moved so as to displace the tray having received the sheet away from the sheet inlet so that the next tray is aligned with the sheet inlet.

In the present invention, the sheet conveying speed by the conveying rollers *7a* and *7b* are switched in response to the sheet discharge from the image forming machine and in response to the release of the sheet from the confinement by the image forming machine.

Referring to FIGS. 7, 8, 9, 10, 11, and 12, another example of controlling the sheet conveying speed of the sheet conveying rollers *7a* and *7b* will be described.

The copying machine C and the sorter S are controlled in general by an communication means not shown such as serial communication. In response to a sorting signal from the copying machine C, the conveying motor M (FIG. 1) of the sorter S starts to rotate.

Figure 7:
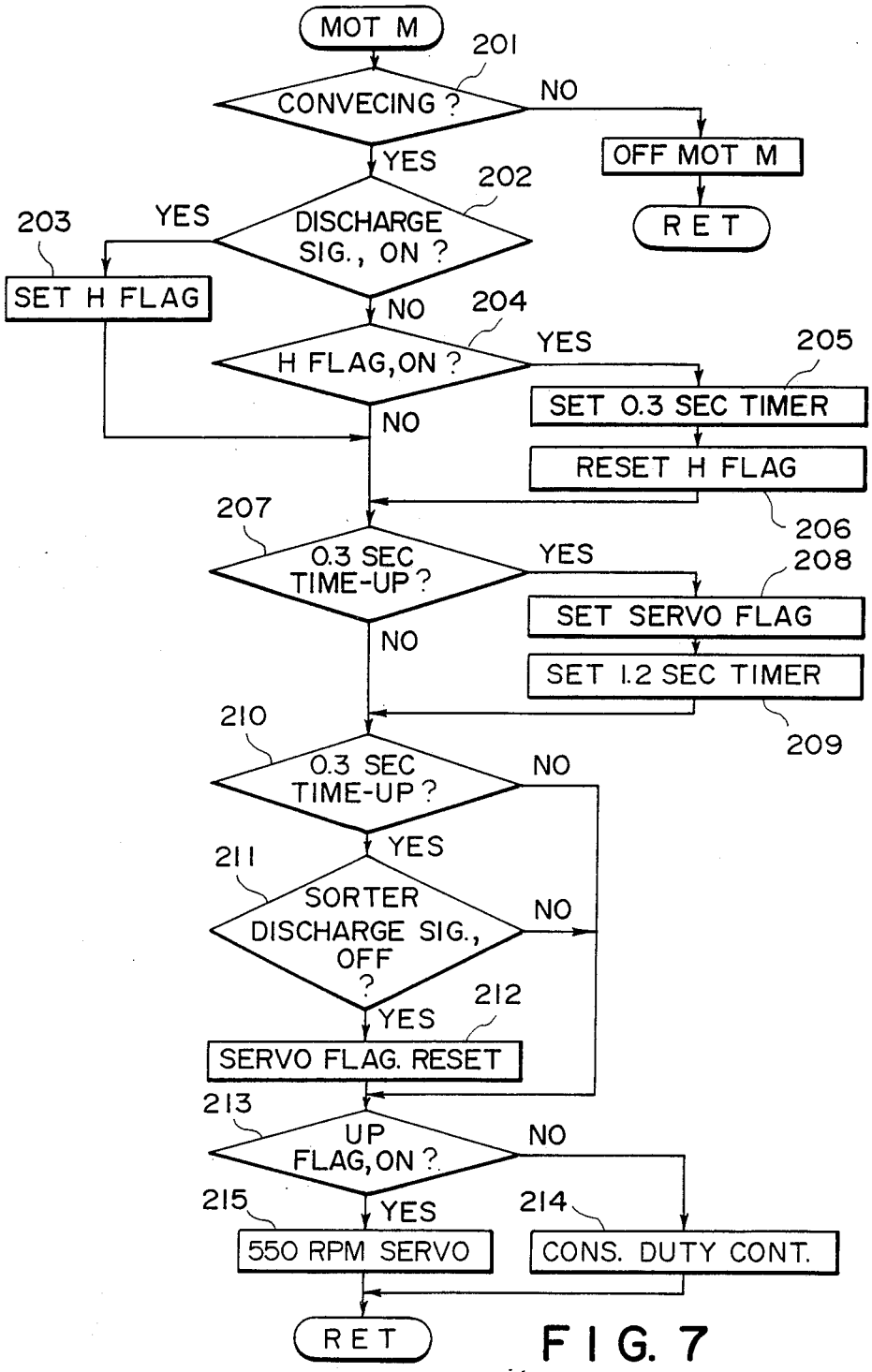
FIG. 7 is a flow chart illustrating an example of sequential control for sheet conveying speed.

FIG. 7 shows a flow chart of a sequential control operation for the conveying speed of the conveying rollers *7a* and *7b*. In this embodiment, the conveying motor M is a DC motor. A DC motor supplied with a constant voltage, involves a tendency that its rotational speed is higher if the load thereto is low, while it is lower if the load thereto is high. The tendency is enhanced when the impedance of the power source is high.

Figure 9:
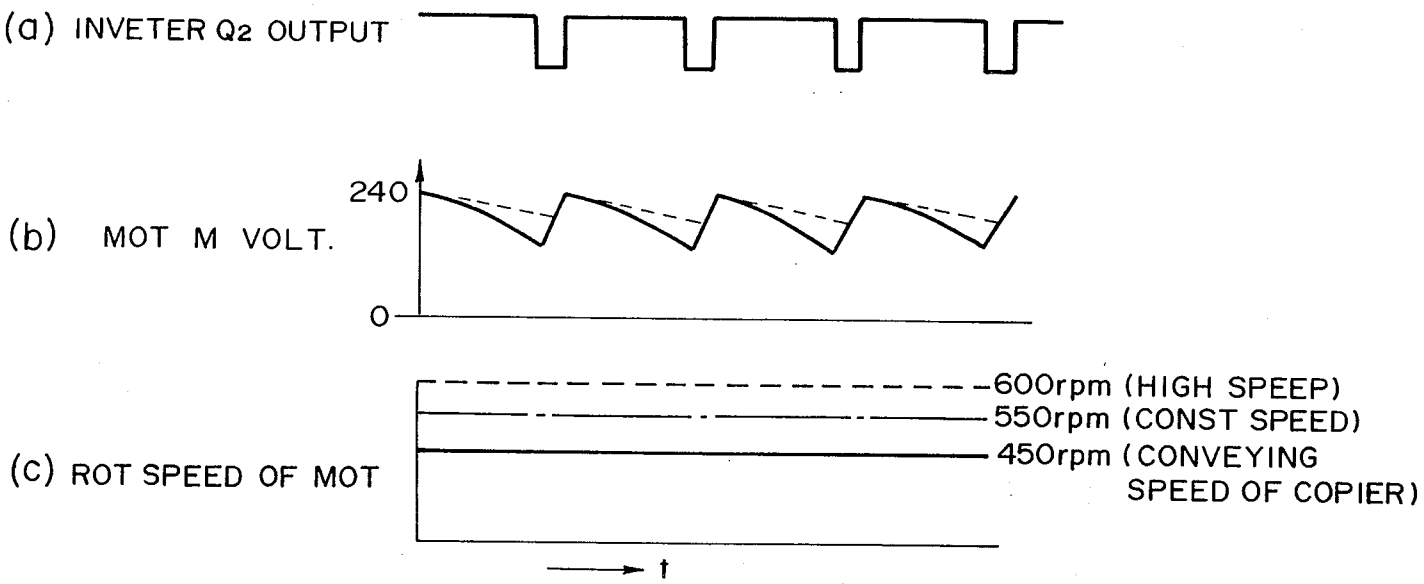
FIG. 9 is a timing chart of operations of an inverter and a motor.
Figure 12:
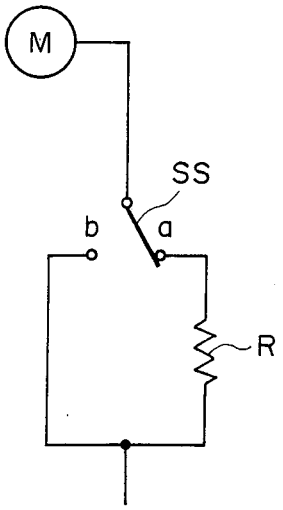
FIG. 12 is a circuit diagram illustrating a switching between high impedance line and a low impedance line.

The present invention utilizes positively this tendency. More particularly, in the normal state, the motor M is connected to a high impedance power source through a switch SS connected to a contact a as shown in FIG. 12. The high impedance is indicated by unreferenced resistor. When the load is low as in the case that the conveying rollers *7a* and *7b* are not conveying a sheet, the current through the motor M is small, so that the voltage across the motor M is high with the result that the motor rotates at a high speed, for example, approximately 600 rpm, as shown by a broken line in FIG. 9 which will be described hereinafter. When the nip between the conveying rollers *7a* and *7b* grips a sheet P, the load to the motor M increases with the result of larger current through the motor M so that the voltage applied to the motor M decreases as shown by a solid line in FIG. 9, (*b*). Therefore, the rotational speed of the motor decreases down to 450 rpm, for example, which corresponds in this embodiment to the sheet discharging speed of the copying machine C as shown in FIG. 9, (*c*).

As will be understood, at the instance when the nip between the conveying rollers *7a* and *7b* catches the sheet P, the rollers are rotating still at the higher speed, i.e. 600 rpm, and the speed gradually decreases thereafter due to the high impedance. By the initial high speed of the rollers *7a* and *7b*, the possible curling of the sheet P between the discharge rollers 3 and the conveying rollers *7a* and *7b* is first removed during the speed decreasing period, in which the sheet conveying speed of the conveying rollers *7a* and *7b* are still higher than the sheet discharging speed of the copying machine. When the curling is removed, the load to the motor M is increased because the sheet is still confined by the copying machine C. Then, due to the load increase, the rotational speed of the motor decreases down to the speed matching the sheet discharging speed determined by the copying machine. In this manner, the initial high speed of the conveying rollers *7a* and *7b* of the sorter S is effective to remove the curling or loop of the sheet, and the conveying speed thereof becomes matched after the loop is removed. Therefore, the sheet P is stably received from the copying machine C by the sorter S.

When the trailing edge of the sheet P is released from the confinement by the copying machine C, the speed of the motor is changed to 550 rpm and is maintained at this speed for a necessary period by a constant speed control which will be described hereinafter.

Figure 10:
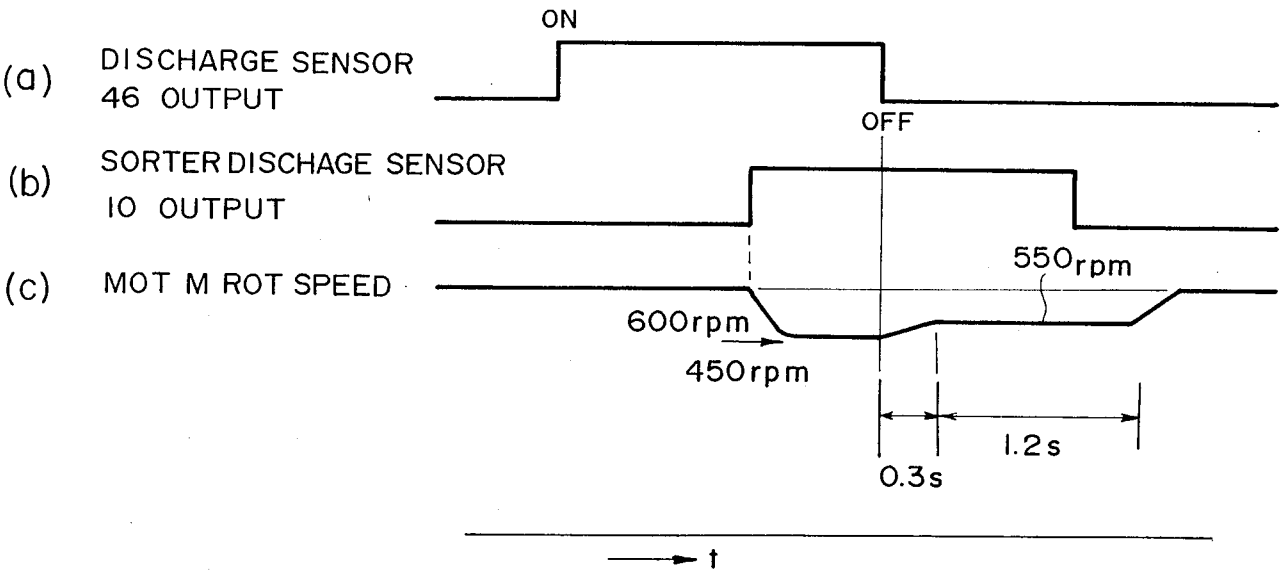
FIG. 10 is a timing chart illustrating timing of various signals.

FIG. 10 is a timing chart among outputs from various sensors and the rotational speed control of the motor M. A sheet discharge signal (a) indicative of the sheet P starting to discharge from the copying machine C provided by the sheet discharge sensor 46 is transmitted through a signal transmitting means (not shown) between the copying machine C and the sorter S. After the sheet discharge signal (a) becomes off, the motor M is switched to a controlled constant speed mode (550 rpm) with a delay of time. The speed in the constant mode is determined so as to make sure the sheet receiving by the tray. The delay time is determined so that the speed of the motor M increases after the trailing edge of the sheet P is completely released from the sheet conveying mechanism of the copying machine C. In this embodiment, the delay time is 0.3 sec as shown in FIG. 10(*c*). The sequential operation described above is indicated by steps 201, 202, 204, 207, 208, 209, 210, 213 and 215 in FIG. 7.

The period of the constant speed mode wherein the rotational speed of the motor M is controlled to be constant, which will be described in detail hereinafter, continues until after the complete discharge of the sheet onto the tray, which is detected by the discharge sheet sensors 9 and 10. In this embodiment, the time period is 1.2 sec as shown in FIG. 10(*b*) and (*c*). This is illustrated in the flow chart of FIG. 7 by the steps 201, 202, 204, 207, 210, 211, 212, 213 and 214.

When the sheet is completely discharged to the sorter S, the speed of the motor M is increased in a low torque under a constant duty control, so that the sorter S is placed in the stand-by state for receiving the next sheet P from the copying machine.

When a relatively thick sheet, such as post card or the like, is conveyed, it tends to slip on the conveying rollers *7a* and *7b*, with the result that the complete discharge thereof is possibly not reached within the predetermined period. In view of this, at step 211 of FIG. 7, if the sheet does not pass the discharge sensors 9 and 10 in a predetermined period, the servo flag is not reset to continue the constant speed mode (550 rpm).

The constant rotational speed control will now be described. There are many known constant rotational speed control method, such as a phase lock loop control (PLL) on the basis of detection of ripples produced by the motor rotation or on detection of rotational speed using an encoder, an electronic governer utilizing back electromotive force of the motor and speed stabilization by compensating a voltage drop within the motor. Those methods may be employed in the present invention.

However, in the embodiment of the present invention, a constant rotational speed control is accomplished by more simple circuit utilizing a microcomputer.

Figure 8:
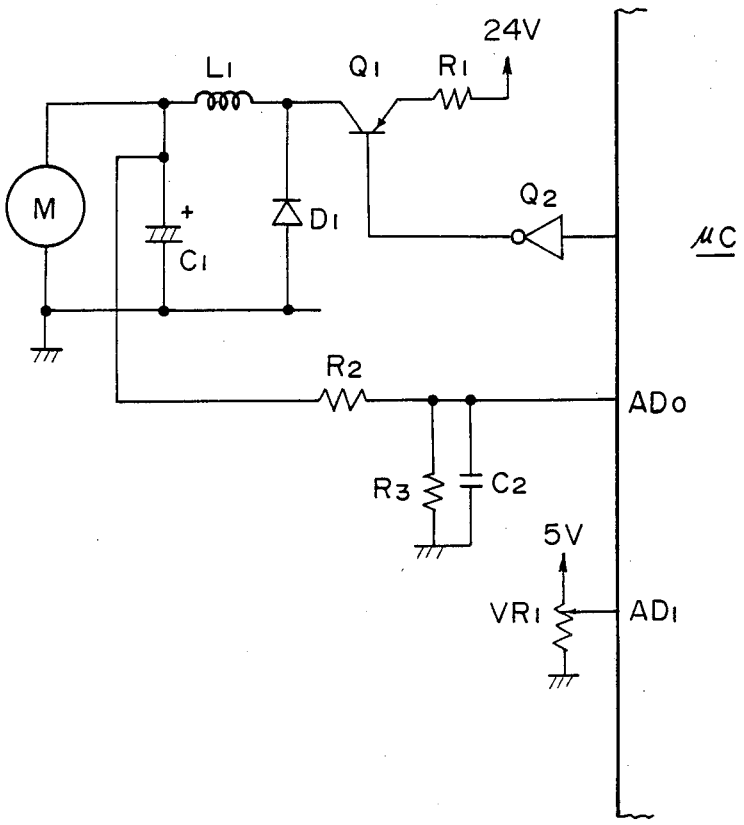
FIG. 8 shows a circuit diagram illustrating an example of a control for providing a constant rotational speed.

Referring to FIG. 8, there is shown a constant speed control circuit used with the sorter S of the embodiment of the present invention. The motor M is controlled by the circuit comprising various resistors R1, R2, R3, a variable resistor VR1, capacitors C1 and C2, a diode D1, a winding L1, a transistor Q1 and an inverter electrically connected as shown in FIG. 8. The circuit is controlled by a microcomputer. FIG. 9 shows the relationship among an output of the inverter Q2, a voltage applied to the motor M and a rotational speed of the motor. When the inverter Q2 produces a pulse as shown in FIG. 9(*a*), the transistor Q1 becomes conductive so that the voltage of 24 V by the power source is applied to the conveying motor M and the capacitor C1 through the resistor R1, the transistor Q1 and the winding L1 (inductance), thus starting the motor M and simultaneously starting to charge the capacitor C1. When the pulse from the inverter Q2 is made off by the microcomputer, electromotive force is generated by the winding L1 through the diode D1. In this manner, a voltage smoothed by the capacitor C1 and the winding L1 is applied to the motor M.

Figure 11:
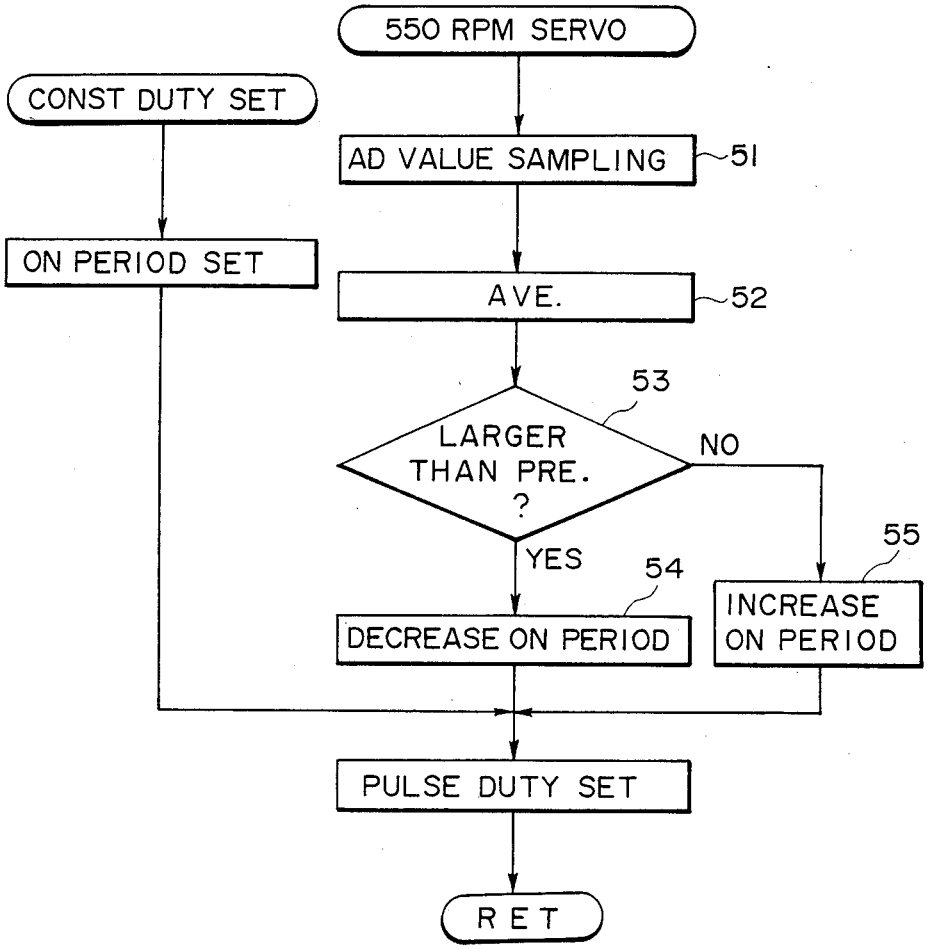
FIG. 11 is a flow chart of a sequential control for providing a constant rotational speed.

FIG. 11 is a flow chart of a sequential control by the microcomputer to provide the constant rotational speed of the motor M. The voltage applied to the motor in the manner described above is divided by the resistors R2 and R3. One of the divided voltages is fed back to an analog/digital converter AD0 of the microcomputer. The digitalized values are sampled at step 51 in FIG. 11 and are averaged at step 52 of FIG. 11. By the averaging operation, the voltage applied to the motor M is correctly obtained.

The averaged motor voltage is compared with a desired value which has been set by a setting variable resistor VR1, at step 53. When the averaged voltage is higher than the desired voltage, the period during which the pulse is "0" is decreased at step 54, and on the contrary, when it is smaller, the time period is increased at step 55.

In this manner, the constant voltage is applied to the motor irrespective of the torque load to the motor M by the above described control, the motor is controlled at the rotational speed of 550 rpm.

It is preferable that the switch SS shown in FIG. 12 is switched to a contact b in the 550 rpm mode to minimize the influence of a possible load change to the constantness of the motor speed.

As described, according to this embodiment, when the sorter S is used with a copying machine C having a relatively low sheet discharging speed corresponding to the rotational speed of the motor M of the sorter S of 450 rpm, for example, the motor M is driven under a low torque by a high impedance power source at a speed, for example 600 rpm of the rotational speed of the motor M which is higher than the discharging speed of the copying machine C (450 rpm). When the sheet P becomes stretched between the copying machine C and the sorter S (after the curling is removed), the sorter driving system, more particularly, the motor follows the sheet discharging speed of the copying machine C because of the high impedance as described hereinbefore by the selector switch SS set at contact a, as shown in FIG. 12. When the sheet P is further discharged to be released from the discharging rollers 3 of the copying machine C (FIG. 1), the switch SS is changed to the contact b, and the motor rotational speed is controlled to be constant at a higher speed, for example 550 rpm which is determined so as to shoot the sheet P onto the tray of the sorter S at a sufficiently high speed to be properly aligned on the tray. Therefore, the stretching of the sheet P between the sorter S and the copying machine C does not occur, and therefore, the noise and the wearing of the conveying rollers can be prevented. Additionally, the loop formed between the sorter S and the copying machine C can be removed at the first stage of the sheet conveying operation by the sorter S. In the foregoing description, the normal speed of the motor M is 600 rpm which is higher than the sheet discharging speed by the copying machine C corresponding to 450 rpm.

However, the normal speed may be 450 rpm which is equal to the sheet discharging speed. Then, it is not necessary to first lower the speed of the motor when the sorter S receives the sheet. In this case, the rotational speed of the motor M is changed to 450 rpm after the sheet is completely discharged onto the tray of the sorter S. The normal speed, however, is preferably higher than the sheet discharging speed by the copying machine C, since then the loop or curling of the sheet formed between the sorter S and the copying machine C can be removed at the initial stage of the sheet conveyance by the sheet conveying rollers 7*a* and 7*b* of the sorter S due to the higher initial conveying speed. Further, the normal speed of the motor M may be 550 rpm. Then, it is not necessary to change the speed of the motor after the sheet is completely discharged onto the tray, as will be understood from the foregoing. From the standpoint of quickly removing the loop to ensure the conveyance of the sheet, however, 600 rpm is better.

In the foregoing embodiments, the sheet handling apparatus has been described as a sorter, and image forming apparatus has been described as being a copying machine C. However, the sheet handling apparatus according to the present invention is not limited to those cases. For example, it may be another type sheet stacking apparatus and is applicable to image recording or other image forming printer or the like.

As described in the foregoing, according to the present invention, the sheet conveying speed of the sheet handling device is changed in response to the sheet discharge from an image forming machine with which the sheet handling device is used. Therefore, the drawbacks resulting from the stretching of the sheet which is otherwise caused between the image forming apparatus and the sheet handling apparatus is obviated. Additionally, the sheet handling apparatus is applicable to various image forming machines having different sheet discharging speeds without deteriorating the good alignment on the trays of the sheet handling apparatus.

While the invention has been described with reference to the structures disclosed herein, it is not confined to the details set forth and this application is intended to cover such modifications or changes as may come within the purposes of the improvements or the scope of the following claims.

What is claimed is:

1. A sheet stacking apparatus usable with an image forming apparatus having a sheet discharging outlet, comprising:

a sheet stacking portion;

conveying means for receiving a sheet material from the sheet outlet of the image forming apparatus and conveying the sheet material to said sheet stacking portion; and motor means for driving said conveying means to impart to the sheet material a first sheet speed which is higher than a sheet discharging speed of the image forming apparatus to absorb a loop of the sheet material between said image forming apparatus and said conveying means, then to feed the sheet material at a second speed matching the sheet discharging speed, and then to impart to the sheet material a third sheet speed which is higher than the second speed after the sheet material is released from the image forming apparatus.

2. An apparatus according to claim 1, wherein the releasing of the sheet from the image forming apparatus is transmitted as a release signal produced by sheet detecting means disposed at the sheet discharge outlet of the image forming apparatus.

3. A sheet stacking apparatus usable with an image forming apparatus having a sheet discharging outlet, comprising:

a sheet stacking portion;

conveying means for receiving a sheet material from the sheet outlet of the image forming apparatus and conveying the sheet material to said sheet stacking portion;

detecting means for detecting discharge of the sheet material through the sheet outlet and for detecting completion of the discharge by detecting a trailing edge of the sheet material; and motor means for driving said conveying means at a controlled speed to provide a lower conveying speed matching a sheet conveying speed of said image forming apparatus after the sheet material is detected by said detecting means and to provide a higher conveying speed which is higher than the lower speed after the trailing edge of the sheet material is detected by said detecting means.

4. A sheet stacking apparatus usable with an image forming apparatus having a sheet discharging outlet, comprising:

a sheet stacking portion;

conveying means for receiving a sheet material from the sheet outlet of the image forming apparatus and conveying the sheet material to said sheet stacking portion; and motor means for driving said conveying means to impart to the sheet material a first sheet speed which is higher than a sheet discharging speed of the image forming apparatus to absorb a loop of the sheet material between the image forming apparatus and said conveying means, then to feed the sheet material at a second speed matching the sheet discharging speed, and then to impart to the sheet material a third sheet speed which is higher than the second speed after the sheet material is released from the image forming apparatus, said first sheet speed being higher than said third sheet speed.

5. A sheet stacking apparatus usable with an image forming apparatus having a sheet discharging outlet, comprising:

a sheet stacking portion;

conveying means for receiving a sheet material from the sheet outlet of the image forming apparatus and conveying the sheet material to said sheet stacking portion; and motor means for driving said conveying means at a controlled speed to provide a relatively low speed of said conveying means matching a sheet conveying speed of said image forming apparatus while a load is imparted to said conveying means by the image forming apparatus and to provide a relatively high speed of said conveying means after said load is removed.

6. An apparatus according to claim 5, wherein said driving means includes a DC motor.

7. An apparatus according to claim 5, wherein said driving means includes a DC motor controlled by a high impedance power source.

8. An apparatus according to claim 5, 6 or 7, wherein said stacking portion includes plural sorter bins and the bins are movable up or down to provide, after a said bin receives a sheet, a large inlet for a next sheet.

9. A sheet stacking apparatus usable with an image forming apparatus having a sheet discharging outlet comprising:

a sheet stacking portion;

conveying means for receiving a sheet material from the sheet outlet of the image forming apparatus and conveying the sheet material to said sheet stacking portion motor means for driving said conveying means at a normal sheet conveying speed, and for changing the conveying speed of said conveying means in response to sheet discharge from the image forming apparatus to match the conveying speed with a speed at which the sheet is discharged from the image forming apparatus first detecting means for detecting discharge of the sheet from the sheet discharge outlet of the image forming apparatus and second detecting means for detecting receipt of the sheet material by the stacking portion;

timer means for counting a predetermined period of time from detection by said first detecting means; and control means for maintaining the normal speed if the second detecting means does not detect the receipt at the time when the timer means counts up.

10. A sheet stacking apparatus usable with an image forming apparatus having a sheet discharging outlet comprising:

a sheet stacking portion;

conveying means for receiving a sheet material from the sheet outlet of the image forming apparatus and conveying the sheet material to said sheet stacking portion;

motor means for driving said conveying means at a normal sheet conveying speed, and for changing the conveying speed of said conveying means in response to sheet discharge from the image forming apparatus to match the conveying speed with a speed at which the sheet is discharged from the image forming apparatus;

first detecting means for detecting discharge of the sheet from the sheet discharge outlet of the image forming apparatus and second detecting means for detecting receipt of the sheet material by the stacking portion;

timer means for counting a predetermined period of time from detection by said first detecting means; and control means for maintaining the normal speed if the second detecting means does not detect the receipt at the time when the timer means counts up, said motor means further providing a first speed higher than said sheet discharge speed.

11. An apparatus according to claim 10, wherein the releasing of the sheet from the image forming apparatus is transmitted as a release signal produced by sheet detecting means disposed at the sheet discharge outlet of the image forming apparatus, and wherein in response to the release signal, the speed of said conveying means by said motor means is changed to a relatively high speed.

12. An apparatus according to claim 11, wherein said motor means is provided with a control circuit for switching between said first speed and said relatively high speed.

13. An image forming apparatus, comprising:

sheet discharging means for discharging a sheet material which has been subjected to an image forming operation; and a sheet stacking portion;

conveying means for receiving a sheet material from the sheet outlet of the image forming apparatus and conveying the sheet material to said sheet stacking portion; and motor means for driving said conveying means to impart to the sheet material a first sheet speed which is higher than a sheet discharging speed of the image forming apparatus to absorb a loop of the sheet material between said image forming apparatus and said conveying means, then to feed the sheet material at a second speed matching the sheet discharging speed, and then to impart to the sheet material a third sheet speed which is higher than the second speed after the sheet material is released from the image forming apparatus.

14. An image forming apparatus, comprising:

sheet discharging means for discharging a sheet material which has been subjected to an image forming operation; and a sheet stacking device including, a sheet stacking portion;

conveying means for receiving a sheet material from the sheet outlet of the image forming apparatus and conveying the sheet material to said sheet stacking portion;

motor means for driving said conveying means at a controlled speed to provide a relatively low speed of said conveying means matching a sheet conveying speed by said image forming apparatus while a load is imparted to said conveying means by the image forming apparatus and to provide a relatively high speed of said conveying means after said load is removed.

15. An image forming apparatus, comprising:

sheet discharging means for discharging a sheet material which has been subjected to an image forming operation; and a sheet stacking device including, a sheet stacking portion;

conveying means for receiving a sheet material from the sheet outlet of the image forming apparatus and conveying the sheet material to said sheet stacking portion;

motor means for driving said conveying means at a normal sheet conveying speed, and for changing the conveying speed of said conveying means in response to sheet discharge from the image forming apparatus to match the conveying speed with a speed at which the sheet is discharged from the image forming apparatus;

first detecting means for detecting discharge of the sheet from the sheet discharge outlet of the image forming apparatus and second detecting means for detecting receipt of the sheet material by the stacking portion;

timer means for counting a predetermined period of time from detection by said first detecting means; and control means for maintaining the normal speed if the second detecting means does not detect the receipt at the time when the timer means counts up.

16. A sheet stacking apparatus usable with an image forming apparatus having a sheet discharging outlet comprising:

a sheet stacking portion;

conveying means for receiving a sheet material from the sheet outlet of the image forming apparatus and conveying the sheet material to said sheet stacking portion; and motor means for driving said conveying means at a controlled speed to provide a relatively low speed of said conveying means matching a sheet conveying speed of said image forming apparatus while a load is imparted to said conveying means by the image forming apparatus and to provide a relatively high speed of said conveying means after said load is removed, said motor means further providing a first speed higher than said high speed.

17. An apparatus according to claim 16, wherein the releasing of the sheet from the image forming apparatus is transmitted as a release signal produced by sheet detecting means disposed at the sheet discharge outlet of the image forming apparatus, and wherein in response to the release signal, the speed of said conveying means by said motor means is changed to a relatively high speed.

18. An apparatus according to claim 17, wherein said motor means is provided with a control circuit for switching between said first speed and said relatively high speed.

19. An apparatus according to claim 1 or 16, wherein said sheet stacking portion contains plural sorter bins, and the bins are movable up or down to provide, after said bin receives a sheet, a large inlet for a next sheet.

20. A sheet stacking apparatus usable with an image forming apparatus having a sheet discharging outlet, comprising:

a sheet stacking portion;

conveying means for receiving a sheet material from the sheet outlet of the image forming apparatus and conveying the sheet material to said sheet stacking portion; and motor means for driving said conveying means to impart to the sheet material a first sheet speed which is higher than a sheet discharging speed of the image forming apparatus to absorb a loop of the sheet material between the image forming apparatus and said conveying means, then to feed the sheet material at a second sheet speed matching the sheet discharging speed.

21. An image forming apparatus, comprising:

sheet discharging means for discharging a sheet material which has been subjected to an image forming operation; and a sheet stacking device, which includes, a sheet stacking portion;

conveying means for receiving a sheet material from the sheet outlet of the image forming apparatus and conveying the sheet material to said sheet stacking portion; and motor means for driving said conveying means to impart to the sheet material a first sheet speed which is higher than a sheet discharging speed of the image forming apparatus to absorb a loop of the sheet material between the image forming apparatus and said conveying means, then to feed the sheet material at a second sheet speed matching the sheet discharging speed.

* * * * *

UNITED STATES PATENT AND TRADEMARK OFFICE

CERTIFICATE OF CORRECTION

PATENT NO. : 4,974,828

DATED : December 4, 1990

INVENTOR(S) : Kazuhiro MATSUO ET AL

It is certified that error appears in the above-identified patent and that said Letters Patent is hereby corrected as shown below:

COLUMN 12:

Line 2, "portion" should read --portion;--; and

Line 9, "apparatus" should read --apparatus;--.

COLUMN 13:

Line 23, "portion;" should read --portion; and--.

SHEET 6 OF 11:

Figure 7, "CONVECING" should read --CONVEYING--.

SHEET 8 OF 11:

Figure 9, "INVETER" should read --INVERTER--.

Signed and Sealed this

Fourth Day of August, 1992

*Attest:*

DOUGLAS B. COMER

*Attesting Officer*

*Acting Commissioner of Patents and Trademarks*